US006739357B2

(12) United States Patent
Pedrini et al.

(10) Patent No.: US 6,739,357 B2
(45) Date of Patent: May 25, 2004

(54) DEVICE FOR SMOOTHENING THE UNWINDING FROM THE CYLINDER OF THE LOOPS OF YARN FORMING THE WEFT RESERVE, IN WEFT SUPPLIERS FOR FLUID JET LOOMS

(75) Inventors: Giovanni Pedrini, Leffe (IT); Ruggero Magoni, Gazzaniga (IT)

(73) Assignee: L.G.L. Electronics S.p.A., Gandino (IT)

( * ) Notice: Subject to any disclaimer, the term of this patent is extended or adjusted under 35 U.S.C. 154(b) by 114 days.

(21) Appl. No.: 10/146,878

(22) Filed: May 17, 2002

(65) Prior Publication Data

US 2003/0000593 A1 Jan. 2, 2003

(30) Foreign Application Priority Data

Jun. 14, 2001 (IT) ..... TO2001A0569

(51) Int. Cl.[7] ..... B65H 51/20
(52) U.S. Cl. ..... 139/452
(58) Field of Search ..... 139/435.1, 435.6, 139/450, 452, 453; 226/118.1, 118.2, 118.3; 242/365.4

(56) References Cited

U.S. PATENT DOCUMENTS

| | | | | |
|---|---|---|---|---|
| 2,629,566 A | * | 2/1953 | King | 242/128 |
| 3,761,031 A | * | 9/1973 | Pfarrwaller | 242/365.4 |
| 4,418,729 A | * | 12/1983 | Chiba et al. | 139/452 |
| 4,633,917 A | * | 1/1987 | Riboli | 139/452 |
| 4,852,617 A | * | 8/1989 | Hamer et al. | 139/452 |
| 5,343,899 A | * | 9/1994 | Jacobsson et al. | 139/452 |
| 6,488,054 B2 | * | 12/2002 | Zenoni et al. | 139/452 |

* cited by examiner

*Primary Examiner*—Danny Worrell
(74) *Attorney, Agent, or Firm*—Guido Modiano; Albert Josif; Daniel O'Byrne

(57) ABSTRACT

A device for smoothening the unwinding from the cylinder of the loops of yarn of the weft reserve in weft suppliers for fluid jet looms, is described. The device comprises a pneumatic device capable of subjecting the yarn to a fluid flow, such as an air stream, having at least one motion component directed in the running direction of the yarn. The flow, independently from the dimensional and superficial characteristics of the yarn, maintains the latter constantly under mechanical tension, so that the slackening of the loops wound on the terminal portion of the cylinder of the supplier is prevented.

7 Claims, 1 Drawing Sheet

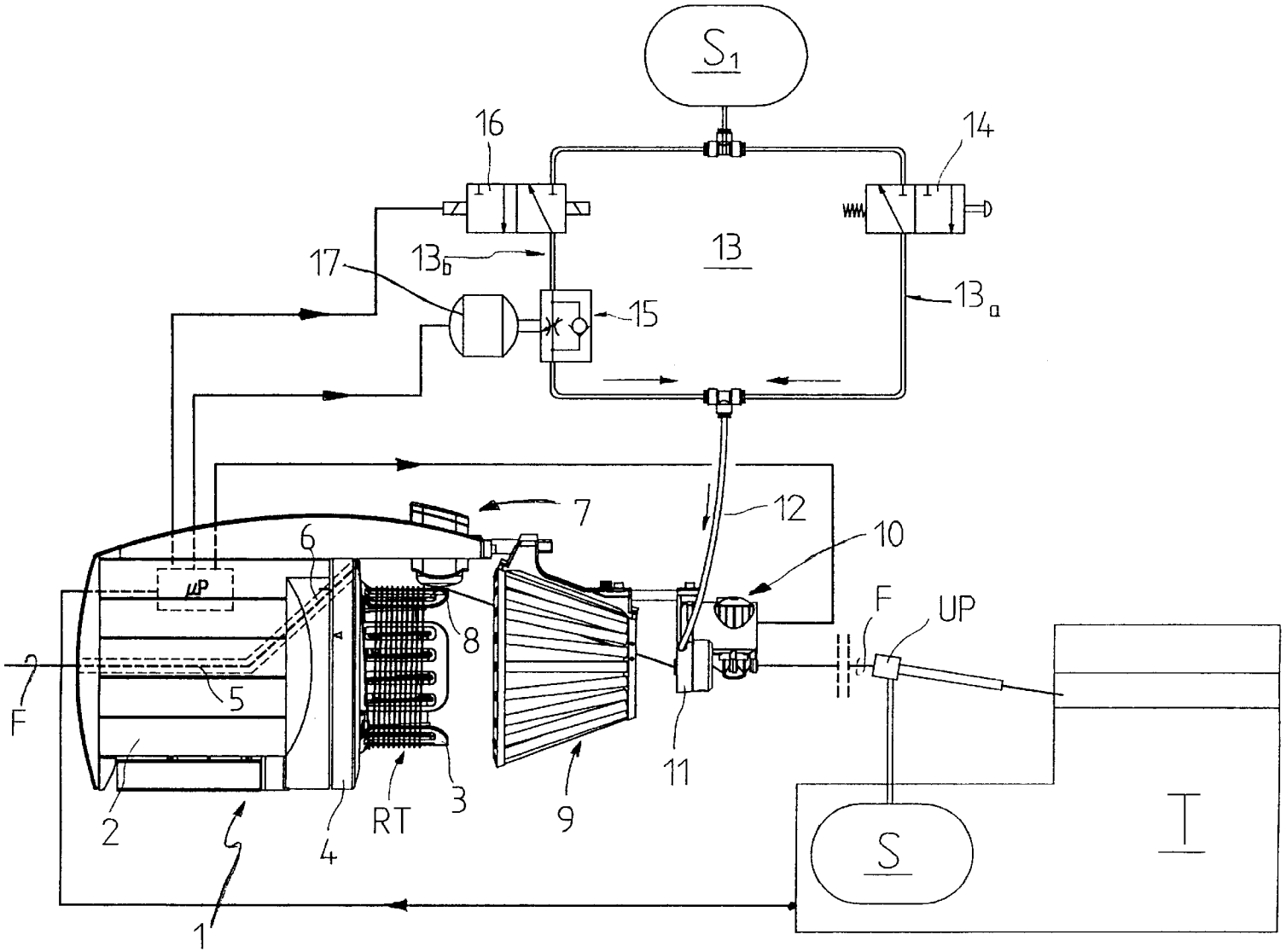
T
S
UP
F
10
12
11
9
7
8
3
RT
4
6
5
1
2
F
S1
13
14
13a
15
16
13b
17
μP

DEVICE FOR SMOOTHENING THE UNWINDING FROM THE CYLINDER OF THE LOOPS OF YARN FORMING THE WEFT RESERVE, IN WEFT SUPPLIERS FOR FLUID JET LOOMS

BACKGROUND OF THE INVENTION

The present invention is concerned with a device for smoothening the unwinding of the loops of yarn forming the weft reserve on the cylinder of a weft supplier for a fluid jet looms, such as an air jet loom or a water jet loom.

As well known, the weft suppliers are capable of storing a yarn reserve, in form of loops wound on a stationary cylinder, and of supplying the loom by unwinding a number of loops matching the length L of yarn required by the loom at each weft insertion, the length L equalling the width of the fabric being woven.

In the specific case of fluid jet looms, the weft supplier also has the task of pre-measuring the length L and such a task is performed by counting, typically by means of a photo-sensor, the loops of yarn which have been unwound; being $$L=n\pi D$$

where n is the number of loops which have been unwound and D is the diameter of the stationary cylinder of the supplier.

The unwinding of the yarn is controlled by an electrically-controlled stop comprising a movable finger that, when energized, engages the cylinder, in order to block the running of the yarn when the n-th loop has been reached.

The operating time of the stop device mounted on current weft suppliers is quite short, typically in the range of 10 to 20 milliseconds, due to the high operating speed of a modern fluid jet loom, which is able to insert about 1500 meters of weft per minute. This fact causes a peak in the mechanical tension of the yarn, downstream of the stop finger, which tension peak must be smoothed in order to prevent breaking of the yarn. Upstream of the stop finger, it causes slackening of one or more of the loops that are wound on the terminal portion of the cylinder, because of the inertia dragging actions caused by the quick stopping of the running yarn.

Nowadays, in order to avoid such phenomena and to smoothen the unwinding and stopping of the yarn as well as possible, smoothening devices of several kinds are used, typically providing a modulated braking of the weft yarn, e.g. as disclosed in prior European Patent Application No. 99112784.6. Such devices, which are interposed between the weft supplier and the loom, are put into action during the unwinding of the last loop, in order to slow down the running of the yarn while maintaining it in tension, in order to attenuate the deceleration peak of the yarn when the stop finger is driven.

Although such known smootheners operate satisfactorily to damp the mechanical tension in the yarn downstream of the stop finger, they are not capable of effectively preventing the slackening of the loops upstream of the stop finger. Moreover, such capability depends on the characteristics of the yarn being processed. Particularly with yarns having a slippery surface and/or having poor elasticity, the above known modulated-braking devices are unable to prevent slackening of one or more of the loops wound on the terminal portion of the cylinder of the supplier, upstream of the stop finger, probably because of their limited ability to brake the yarn and to control its mechanical tension.

Such a circumstance is a serious drawback hindering the regular supply of the weft yarn because, at the time of releasing the next weft length, when the weft yarn is released by the stop finger for restoring its running, two or more loops, rather than single loops, are unwound from the cylinder at the same time, thereby causing the weft length L to be correspondingly increased by a factor n+x (rather than n), and consequently causing the loom to stop, due to the so-called "long weft" signal generated by the optical sensors checking the insertion.

SUMMARY OF THE INVENTION

The present invention has the main object of removing the above drawback, and achieves this and other objects, such as will become apparent from the following disclosure, by means of a device for smoothening the unwinding of the weft yarn having the features defined in the attached claims.

According to the invention, a pneumatic device subjects the weft yarn to a fluid flow, such as an air stream flowing in the same direction as the yarn, in the path between the supplier and the loom. The flow, independently of the size and surface characteristics of the yarn and of the efficiency of the modulated braking device mounted in the same path, maintains the yarn under a constant mechanical tension, whereby, surprisingly for persons skilled in the art, the slackening of the loops wound on the terminal portion of the cylinder of the supplier, upstream of said stop finger, is prevented.

According to an advantageous embodiment of the invention, the pneumatic device that generates the fluid flow for the mechanical tensioning of the yarn comprises the already existing nozzle, mounted on a terminal yarn-guide eyelet and coupled to the modulated braking device, in which pressurized air is supplied for the pneumatic threading of the braking device. The rate of the flow is controlled by at least one flow controller which is operated—according to the features of the weft yarn and to the parameters of the weaving process—so that the mechanical tensioning of the yarn will prevent the slackening of the terminal loops on the cylinder of the supplier.

BRIEF DESCRIPTION OF THE DRAWINGS

The features, aims and advantages of the smoothening device according to the present invention will appear from the following detailed description and with reference to the attached drawing, given by way of non limiting example and showing a schematic view of a pre-measurer/weft supplier for fluid jet looms with the smoothening device according to a preferred embodiment of the invention.

DESCRIPTION OF THE PREFERRED EMBODIMENTS

In the drawings, a weft supplier 1 for a fluid jet loom T, e.g. an air jet loom, comprises, in a way known per se, a stationary housing 2, a stationary cylinder 3 made of cylinder sectors that are radially adjustable in order to change the diameter D of the cylinder, and a rotating disc 4, arranged at the base of the cylinder and driven by a hollow driving shaft 5. A hollow rotating arm 6 is integral to disc 4 and is connected to driving shaft 5. A weft yarn F coming from the reel (not shown) runs through the hollow shaft and arm. Disc 4 swivels to wind the yarn onto cylinder 3 to form a weft reserve RT comprising a plurality of loops of yarn.

At each stroke of the loom, a number of n loops of yarn are unwound from the cylinder, matching the length L of weft inserted by the loom in the stroke.

The number of loops which are unwound is counted, in a way known per se, by a photo-electric sensor and a pulse counter (not shown). The latter, when the penultimate loop (n−1) is reached, causes an electrically controlled yarn-blocking device 7 to be energized. This device is provided with a stop finger 8 which, by dropping in a radial direction, enters a corresponding seat of the underlying cylinder 3, thereby blocking the unwinding of yarn F when the n-th (last) loop is reached.

A "balloon" controlling device 9 and a modulated braking device 10 (or weft brake) are arranged downstream of stop device 7, between supplier 1 and loom T. Weft yarn F passes through both devices and reaches the main nozzle UP of the loom, to which the operating fluid of the loom is supplied by a source S.

The structure of weft brake 10 is outside the scope of the invention. In the example shown, the brake is of the type described in the prior European Patent Application mentioned above and is preceded by a terminal yarn-guide eyelet 11, coupled to the brake and arranged in a way known per se, for threading the brake pneumatically. To that purpose, eyelet 11 is provided with an air supplying conduit 12 opening in the cavity of the eyelet in such a direction as to generate an air flow having a motion component in the running direction of yarn F.

According to the invention, the above air stream is used not only for pneumatically threading brake 10, but also for subjecting the yarn to a continuous mechanical tensioning, applied to the yarn by the air stream, which, surprisingly, prevents the slackening of the loops on cylinder 3 when brake finger 8 is operated—independently of the nature and count of the yarn as well as of the efficiency of brake 10.

To this purpose, conduit 12 is connected to a circuit 13 which delivers pressurized air generated by a source S1. Source S1 comprises a first and a second circuit branch 13*a* and 13*b*, which are connected in parallel to source S1 and to conduit 12, respectively. A pushbutton-operated solenoid valve 14 is connected in the first circuit branch 13*a* which, by manual control, supplies to conduit 12 the air causing the pneumatic threading of weft brake 10. At least one flow regulator 15 and preferably a solenoid valve 16 arranged in series with regulator 15 are connected in the second circuit branch 13*b*.

Flow regulator 15, which is preferably driven by a motor 17 controlled by processor $\mu$P which also controls supplier 1, has the task of optimizing the dynamic performance (speed, flow rate) of the air stream which imparts the continuous mechanical tensioning to yarn F, and of reducing the air consumption, e.g. by repeatedly opening and shutting the regulator in succession. Solenoid valve 16, which is advantageous but not indispensable, operates together with regulator 15 essentially to eliminate or at least reduce the flow rate transients caused by the intermittent operation of the regulator.

The structure of the device described above is particularly efficient and economic because it utilizes the pre-existent pneumatic threading circuit, but it is not limitative for the scope of the invention, because the pneumatic generator of the mechanical tensioning of the yarn may be designed as an autonomous unit, independent of the threading circuit, e.g. where this is not already provided in supplier 1.

Moreover, within the teachings of the invention, the details of implementation and the embodiments can be changed extensively with respect to what has been described and illustrated by way of non limitative example.

The disclosures in Italian Patent Application No. TO2001A000569 from which this application claims priority are incorporated herein by reference.

What is claimed is:

1. A device for smoothening (the) unwinding from (the) a cylinder of (the) yarn loops forming (the) a weft reserve in a weft supplier for a fluid jet loom having an electrically controlled finger for stopping the weft yarn and capable of supplying a predetermined weft length to a weft brake, which is inserted in (the) a path extending from (between) the supplier (and) to the loom, comprising a pneumatic device arranged between the supplier and the weft brake and capable of subjecting the yarn to a fluid flow, the pneumatic device having at least one motion component directed in (the) a running direction of the yarn, which, independently of (the) dimensional and superficial characteristics of the yarn and of (the) efficiency of (the) a modulated braking device mounted in the same path, maintains the yarn constantly under mechanical tension downstream of said electrically controlled (stop) finger, whereby a slackening of the loops wound on (the) a terminal portion of the cylinder of the supplier, upstream of said (stop) electrically controlled finger, is prevented.

2. The smoothening device of claim 1, wherein the fluid flow is an air stream.

3. The smoothening device of claim 1, wherein the pneumatic device generating the fluid flow for imparting a mechanical tensioning to the yarn (consists of) comprises a nozzle mounted in the path of the yarn and supplied by a pneumatic circuit comprising at least one pressurized air source (S1) and at least one flow regulator.

4. The smoothening device of claim 1, wherein the pneumatic device generating the fluid flow for the mechanical tensioning of the yarn comprises (the) a terminal yarn-guide eyelet, coupled to the weft brake, arranged for pneumatically threading the brake and provided with an air-supply conduit connected to said pneumatic circuit and opening into the eye of the eyelet in such a direction as to generate an air flow having a motion component directed in the running direction of the yarn.

5. The smoothening device of claim 4, wherein said supply conduit is connected to a pneumatic circuit, supplying pressurized air and comprising a first and a second circuit branch which are connected in parallel to the source and to the conduit, and in that said first circuit branch includes a manually controlled solenoid valve supplying the air for pneumatically threading the weft brake, and the second circuit branch includes at least one flow regulator controlling (the) dynamic performance of the flow generating the mechanical tensioning of the weft yarn.

6. The smoothening device of claim 5, wherein said second branch of pneumatic circuit further comprises a solenoid valve connected in series with the regulator.

7. The smoothening device of claim 6, wherein said flow regulator is driven by a motor controlled by a processor which controls the supplier and optimizes the dynamic performance ((speed, flow rate)) of the air stream providing the continuous mechanical tensioning of the yarn, and reduces the air consumption(e.g. by means of successively opening and shutting the regulator).

* * * * *